US011739978B2

(12) United States Patent
Parapurath Monangat et al.

(10) Patent No.: US 11,739,978 B2
(45) Date of Patent: Aug. 29, 2023

(54) INTAKE HOOD SYSTEM FOR AN HVAC UNIT

(71) Applicant: Johnson Controls Technology Company, Auburn Hills, MI (US)

(72) Inventors: Naushad Parapurath Monangat, Pune (IN); Gurpreet Singh, Alwar (IN); Gaurav S. Patil, Pune (IN); Karan Garg, Pune (IN); John L. McElvany, Norman, OK (US); John M. Pinkston, Carrollton, TX (US); Josue D. Ferreira, Balch Springs, TX (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 505 days.

(21) Appl. No.: 16/436,534

(22) Filed: Jun. 10, 2019

(65) Prior Publication Data

US 2020/0363080 A1 Nov. 19, 2020

Related U.S. Application Data

(60) Provisional application No. 62/847,155, filed on May 13, 2019.

(51) Int. Cl.

| | |
|---|---|
| ***F24F 13/28*** | (2006.01) |
| ***F24F 7/04*** | (2006.01) |
| ***F24F 8/10*** | (2021.01) |
| ***F24F 7/003*** | (2021.01) |

(52) U.S. Cl.

CPC ..... *F24F 13/28* (2013.01); *F24F 7/003* (2021.01); *F24F 7/04* (2013.01); *F24F 8/10* (2021.01)

(58) Field of Classification Search

CPC ..... F24F 8/10; F24F 7/04; F24F 2007/004; F24F 13/28; B01D 46/0005; B01D 46/2422

USPC ..... 454/158

See application file for complete search history.

(56) References Cited

U.S. PATENT DOCUMENTS

| | | | | |
|---|---|---|---|---|
| 2,825,500 | A * | 3/1958 | McLean | H05K 7/20181 55/470 |
| 4,465,499 | A | 8/1984 | Wawro et al. | |
| 4,843,839 | A | 7/1989 | Davis | |
| 5,512,074 | A | 4/1996 | Hanni et al. | |
| 6,387,164 | B1 * | 5/2002 | Cheng | F24F 3/044 96/66 |
| 6,902,603 | B2 | 6/2005 | Wiser, III et al. | |
| 6,916,352 | B2 * | 7/2005 | Sutton | B01D 46/12 55/483 |
| 8,999,029 | B1 | 4/2015 | Brandt et al. | |

(Continued)

FOREIGN PATENT DOCUMENTS

| | | |
|---|---|---|
| WO | 2018128990 | 7/2018 |

*Primary Examiner* — Allen R. B. Schult

(74) *Attorney, Agent, or Firm* — Fletcher Yoder, P.C.

(57) ABSTRACT

An intake hood system for a heating, ventilation, and/or air conditioning (HVAC) unit includes an intake hood having an inlet configured to receive an air flow into the intake hood, a first support configured to engage a first end of an air filter, and a second support configured to engage a second end of the air filter, where the first support is configured to align with a boundary of the inlet. The intake hood system also includes a lock bar configured to couple to the intake hood while abutting the first support and the second support to secure the air filter within the intake hood.

17 Claims, 15 Drawing Sheets

(56) References Cited

U.S. PATENT DOCUMENTS

| | | | | |
|---|---|---|---|---|
| 9,623,356 | B2 | 4/2017 | Gorman | |
| 2009/0183463 | A1* | 7/2009 | Osborn | F16L 3/16 248/62 |
| 2013/0125520 | A1* | 5/2013 | Gorman | B01D 46/0002 55/509 |
| 2016/0076788 | A1* | 3/2016 | Krupo | F24F 3/044 454/275 |

* cited by examiner

INTAKE HOOD SYSTEM FOR AN HVAC UNIT

CROSS REFERENCE TO RELATED APPLICATIONS

This application claims priority from and the benefit of U.S. Provisional Application Ser. No. 62/847,155, entitled "INTAKE HOOD SYSTEM FOR AN HVAC UNIT," filed May 13, 2019, which is hereby incorporated by reference in its entirety for all purposes.

BACKGROUND

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

A heating, ventilation, and/or air conditioning (HVAC) system may be used to thermally regulate an environment, such as a building, home, or other structure. The HVAC system generally includes an intake system that receives air, such as outdoor air, for circulation within and thermal regulation of the environment. As air is directed through the intake system, the air is directed through a filter that removes dirt, debris, and other particles from the air. In this way, the intake system may provide clean air to the environment after the air passes through the filter. During operation, dirt, debris, and other particles may accumulate on and within the filter, such that the filter may be replaced with a new or clean filter. In some instances, the HVAC system may not be configured for efficient access to the filter. For example, servicing and/or replacing the filter may be difficult for service personnel and may involve removing portions of the intake system or removing the intake system entirely in order to access the filter. As such, service times to replace or clean the filter may be lengthy.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, an intake hood system for a heating, ventilation, and/or air conditioning (HVAC) unit includes an intake hood having an inlet configured to receive an air flow into the intake hood, a first support configured to engage a first end of an air filter, and a second support configured to engage a second end of the air filter, where the first support is configured to align with a boundary of the inlet. The intake hood system also includes a lock bar configured to couple to the intake hood while abutting the first support and the second support to secure the air filter within the intake hood.

In another embodiment, an intake hood system for a heating, ventilation, and/or air conditioning (HVAC) unit includes an intake hood having a first side panel and a second side panel forming an inlet of the intake hood. The first side panel includes a first lateral channel configured to capture a first side of an air filter, and the second side panel includes a second lateral channel configured to capture a second side of the air filter. The intake hood system also includes a first support disposed between the first side panel and the second side panel such that a length of the first support is transverse to corresponding lengths of the first and second lateral channels, where the first support is configured to capture a first end of the air filter and align with the inlet. Additionally, the intake hood system includes a second support disposed between the first side panel and the second side panel and configured to capture a second end of the air filter.

In yet another embodiment, an intake hood system for a heating, ventilation, and/or air conditioning (HVAC) unit includes a first side panel and a second side panel forming an intake hood. The first side panel and the second side panel each have a first inner flange and a second inner flange. The intake hood system also includes a first C-channel configured to interference fit between the first inner flange and the second inner flange of each of the first side panel and the second side panel and configured to capture a first end of an air filter, and an intermediate bracket configured to interference fit between the first inner flange and the second inner flange of each of the first side panel and the second side panel. The intermediate bracket includes a second C-channel and a third C-channel, where the second C-channel is configured to capture a second end of the air filter, and the third C-channel is configured to capture a first end of an additional air filter. Additionally, the intake hood system includes a fourth C-channel configured to capture a second end of the additional air filter.

BRIEF DESCRIPTION OF THE DRAWINGS

Various aspects of the present disclosure may be better understood upon reading the following detailed description and upon reference to the drawings, in which.

DETAILED DESCRIPTION

Figure 1:
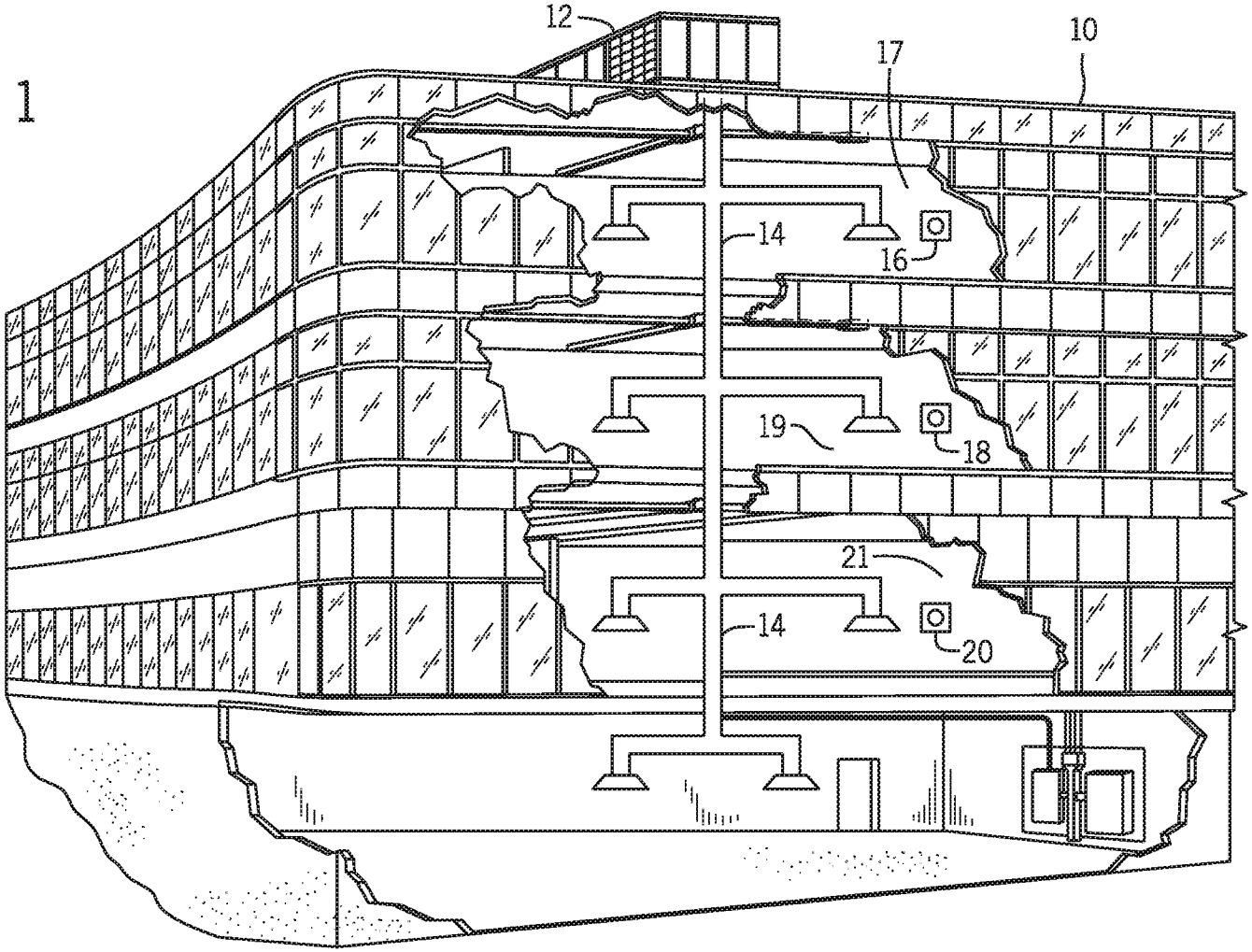
FIG. 1 is a perspective view of an embodiment of a heating, ventilation, and/or air conditioning (HVAC) system for building environmental management that may employ one or more HVAC units, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Generally, a heating, ventilation, and/or air conditioning (HVAC) system may be used to thermally regulate an environment, such as a building, home, or other structure. The HVAC system generally includes an intake hood system that receives air, such as outdoor air, for circulation within and thermal regulation of the environment. As air is directed through the intake hood system, the air is directed through an air filter that removes dirt, debris, and other particles from the air. As a result, the intake hood system may provide clean air to the environment after the air passes through the air filter. During operation of the HVAC system, dirt, debris, and other particles may accumulate on and within the air filter, such that the air filter may be periodically replaced with a clean air filter.

In some instances, servicing and/or replacing the air filter may be complicated for service personnel and may involve removing portions of the intake hood system or the HVAC system generally, such as certain panels, or may involve removing the intake hood system entirely. For example, in a shutter-type intake hood arrangement, the air filter may be pushed upwardly and pulled out of the intake hood system. In some embodiments, a hood of the intake hood system may include side panels that are removed to access the air filter. In certain embodiments, the entire hood is removed from an HVAC unit to access the air filter. As such, service times to replace and/or clean the air filter may be lengthy. Additionally, the removal and reinstallation of the panels and intake hood may cause the panels and intake hood to incur wear, such as wear to fasteners and connecting components of the panels and intake hood.

Accordingly, the present disclosure provides systems and methods for an intake hood system generally positioned at an inlet of an HVAC system and configured to enable improved air filter installation and removal. The intake hood system includes air filters configured to remove dirt, debris, and other particles from air directed through the intake hood system. As discussed in detail below, the disclosed techniques enable quick and efficient access to the air filters, such as access by service personnel to quickly service and/or replace the air filters. For example, the intake hood system may include supports, brackets, and/or side panels that capture the air filters. The supports, the brackets, and/or the side panels may be easily disassembled/uninstalled to remove the air filters and assembled/installed to replace the air filters. As such, the systems and methods described herein improve serviceability of the HVAC system.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

In any case, the HVAC unit 12 may be an air cooled device that implements a refrigeration cycle to provide conditioned air to the building 10. For example, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the air is conditioned, the HVAC unit 12 may supply the conditioned air to the building 10 via ductwork 14 extending throughout the building 10 from the HVAC unit 12. For example, the ductwork 14 may extend to various individual floors or other sections of the building 10. In some embodiments, the HVAC unit 12 may include a heat pump that provides both heating and cooling to the building 10, for example, with one refrigeration circuit implemented to operate in multiple different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other equipment, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and/or the like. Moreover, the control device 16 may include computer systems that are integrated with or separate from other building control or monitoring systems, and even systems that are remote from the building 10. In some embodiments, the HVAC unit 12 may operate in multiple zones of the building and may be coupled to multiple control devices that each control flow of air in a respective zone. For example, a first control device 16 may control the flow of air in a first zone 17 of the building, a second control device 18 may control the flow of air in a second zone 19 of the building, and a third control device 20 may control the flow of air in a third zone 21 of the building.

Figure 2:
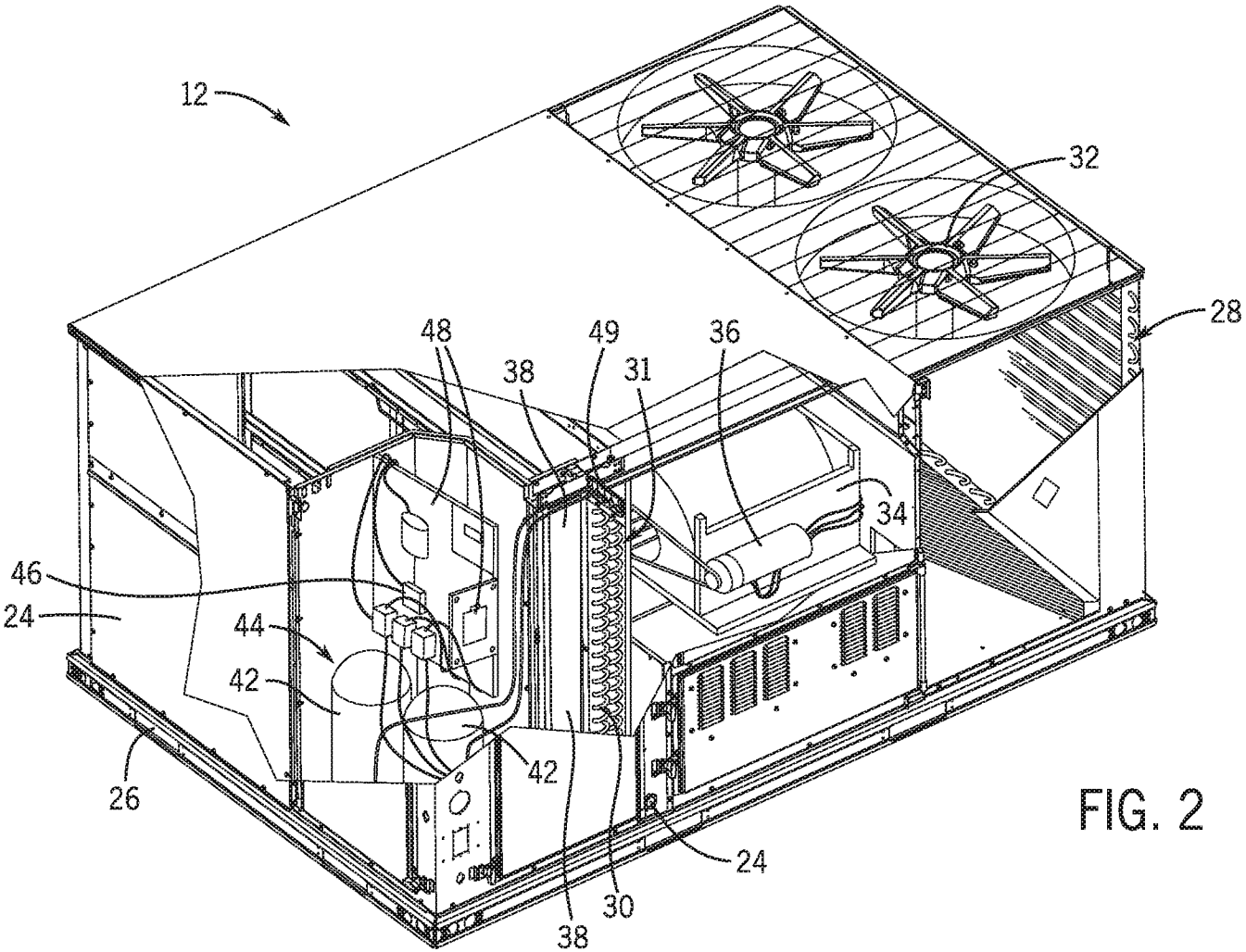
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 or enclosure encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board or controller 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
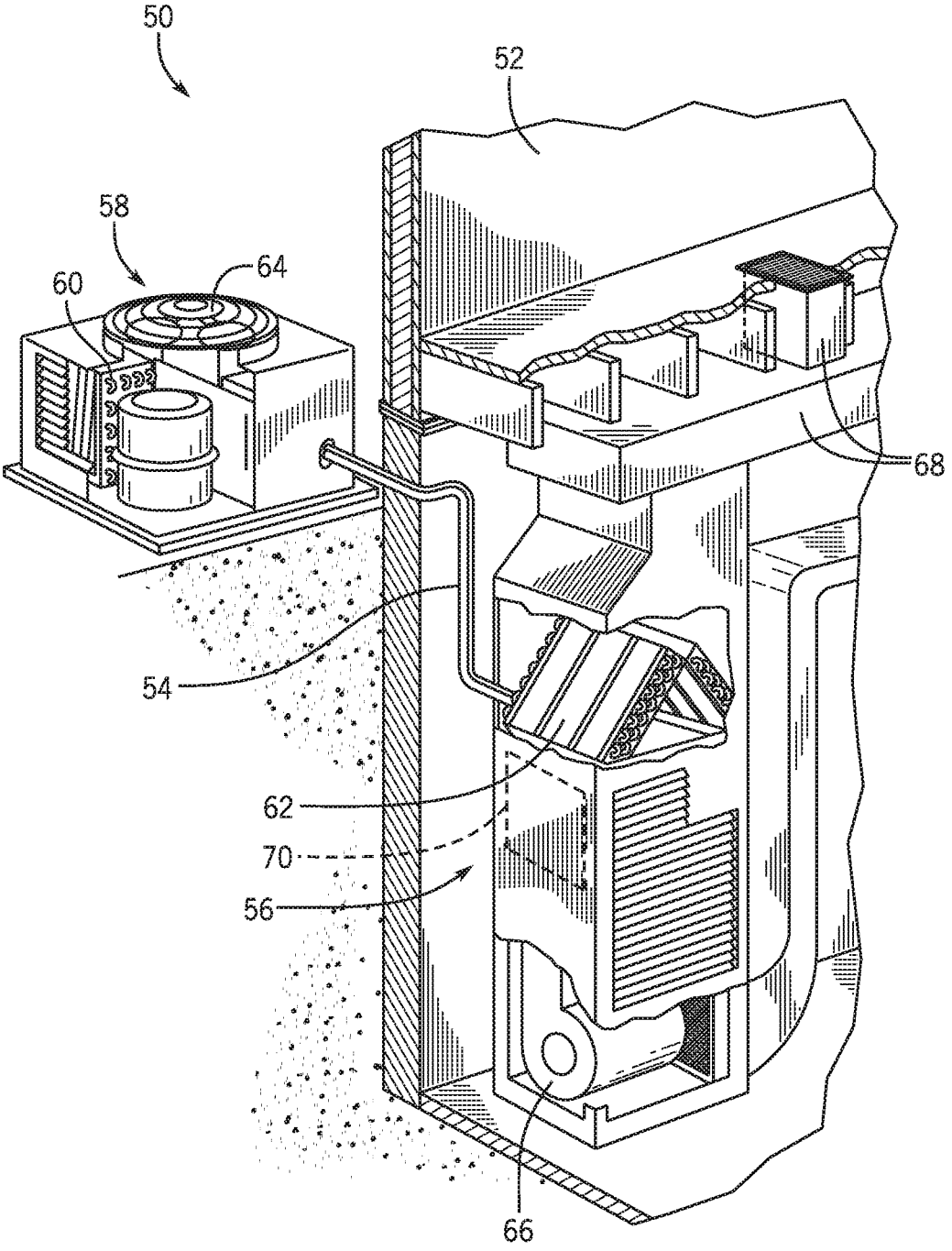
FIG. 3 is a perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit 56 functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace system 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
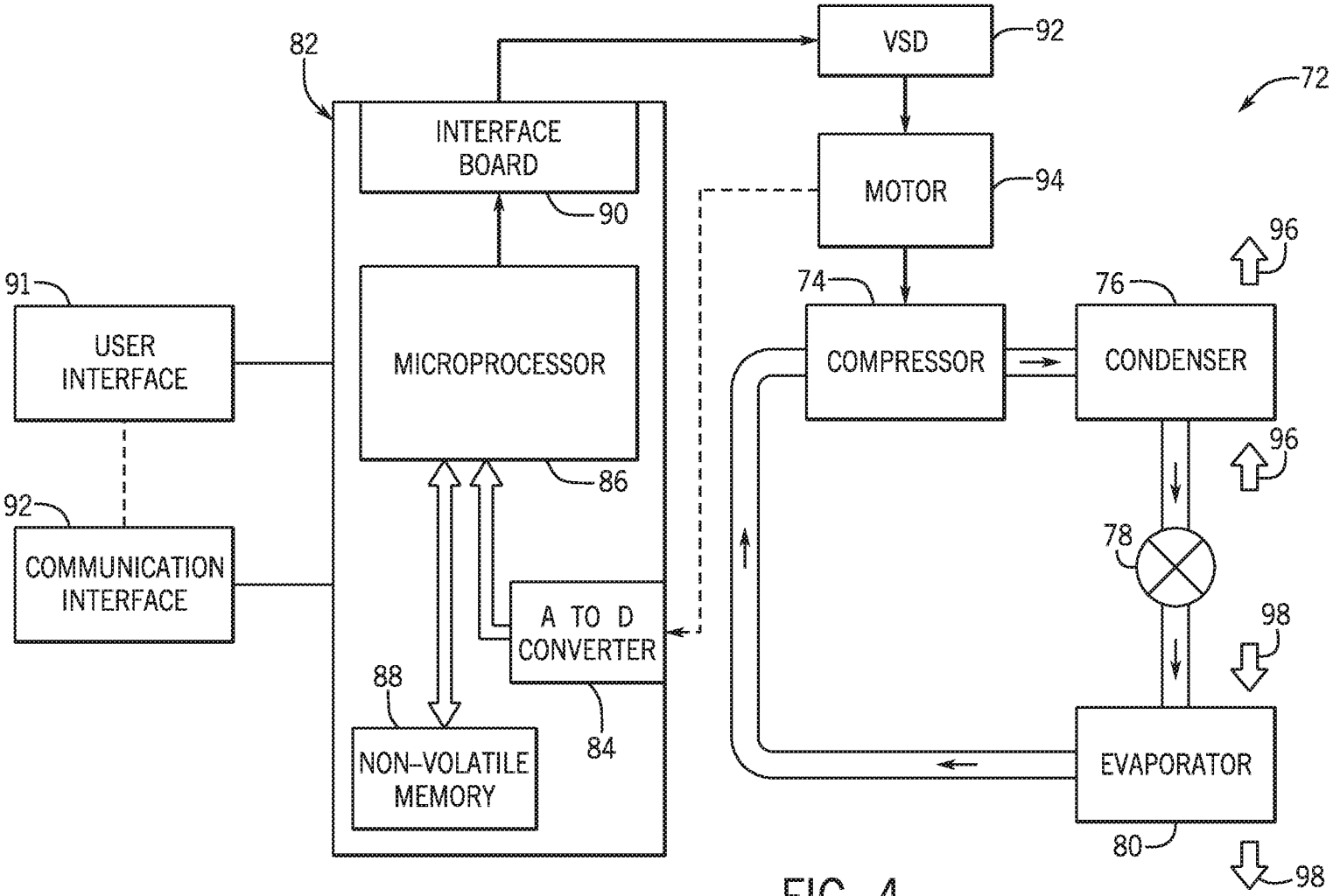
FIG. 4 is a schematic of an embodiment of a vapor compression system that may be used in an HVAC system, in accordance with an aspect of the present disclosure.

FIG. 4 is an embodiment of a vapor compression system 72 that may be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that may be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

The description above with reference to FIGS. 1-4 is intended to be illustrative of the context of the present disclosure. The techniques of the present disclosure may be incorporated with any or all of the features described above, as well as other systems not described above. In particular, as will be discussed in more detail below, the present disclosure provides techniques that enable efficient installation/replacement of air filters of an HVAC system. For example, an intake hood system of the HVAC system may be configured for efficient assembly and/or disassembly to enable efficient installation/replacement of the air filters.

Figure 5:
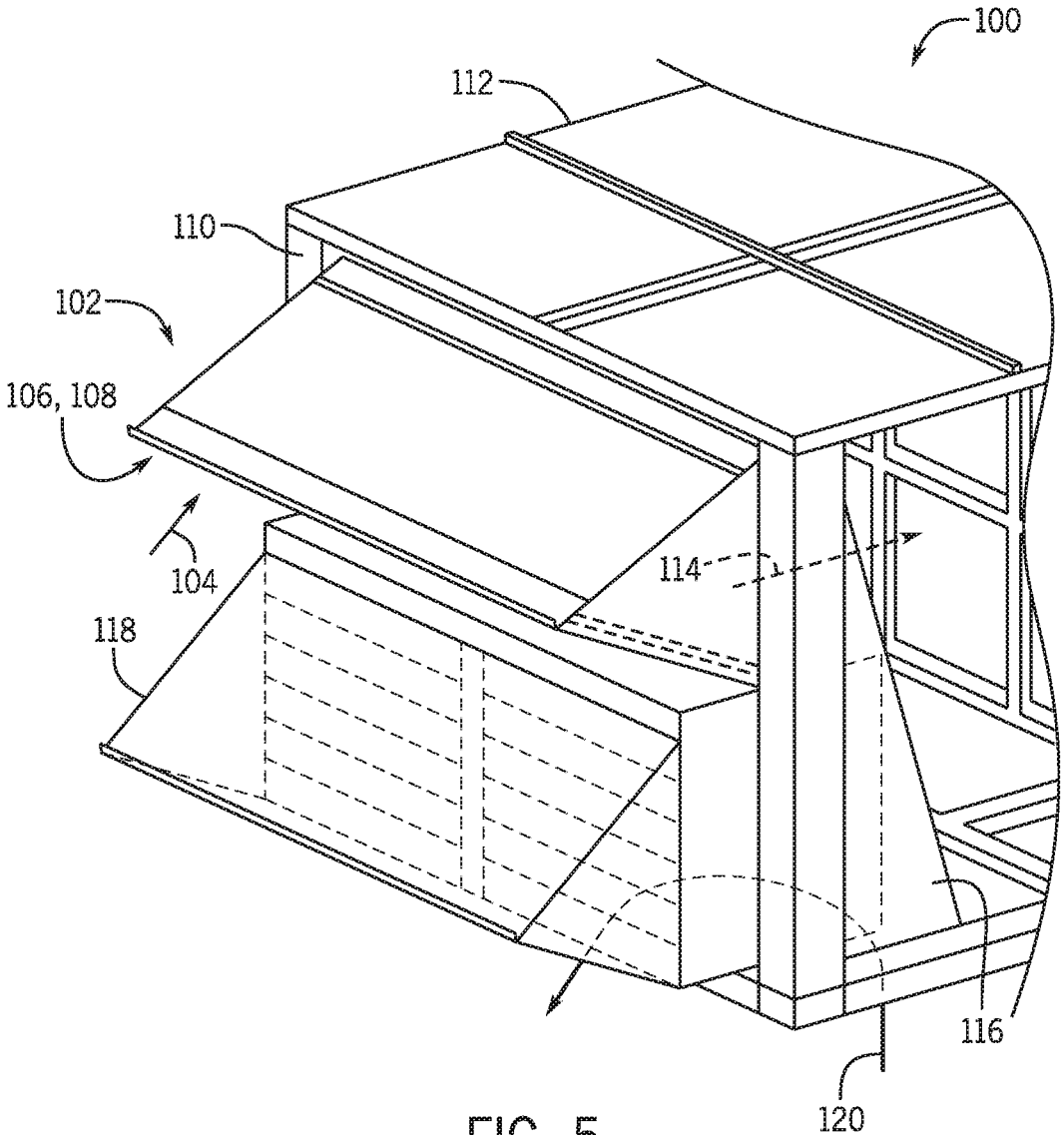
FIG. 5 is a perspective view of an embodiment of an intake hood system coupled to a housing of an HVAC unit, in accordance with an aspect of the present disclosure.

To help illustrate, FIG. 5 is a perspective view an HVAC system 100 having an intake hood system 102. The illustrated HVAC system 100 may include embodiments or components of the HVAC unit 12 shown in FIG. 1, embodiments or components of the residential heating and cooling system 50 shown in FIG. 3, a rooftop unit (RTU), or any other suitable HVAC system. For example, the intake hood system 102 may be an intake hood system of an embodiment of the HVAC unit 12. The intake hood system 102 is configured to receive air into the HVAC system 100. For example, the HVAC system 100 may be positioned outdoors, and the intake hood system 102 may receive unfiltered, outdoor air for conditioning by the HVAC system 100. In certain embodiments, the HVAC system 100 may be positioned indoors, and the intake hood system 102 may receive indoor air containing dust, dirt, and/or smoke. As air passes through the intake hood system 102, as indicated by arrow 104, the air passes through air filters 106 and 108 positioned within the intake hood system 102. The air filters 106 and 108 may be any filters suitable for filtering air, such as filters configured to remove dust, dirt, debris, smoke, and other particles from air. As explained in greater detail below, the air filters 106 and 108 are disposed at an inlet of the intake hood system 102, such as across the inlet, to facilitate access to, insertion, and/or replacement of the air filters 106 and 108.

As illustrated, the intake hood system 102 is coupled to a side 110 of a housing 112 of the HVAC system 100. After passing through the intake hood system 102, air enters the housing 112, as indicated by arrow 114. The housing 112 may direct air toward a heating system, a cooling system, an additional filtering system, or any combination thereof, of the HVAC system 100. For example, if the HVAC system 100 is operating in a heating operating mode, air may be directed from the intake hood system 102 toward the heating system. If the HVAC system 100 is operating in a cooling operating mode, air may be directed from the intake hood system 102 toward the cooling system. After passing through the heating system, the cooling system, the additional filters, and/or other portions of the HVAC system 100, the air may be supplied to a building or other space conditioned by the HVAC system 100.

Air from the conditioned space may also be received by the HVAC system 100 as return air. For example, a flow of return air may enter the housing 112 of the HVAC system 100 and may be directed by a baffle 116 toward a vent 118 to exit the HVAC system 100 via the vent 118, as indicated by arrow 120. In some embodiments or modes of operation, the baffle 116 may direct the return air through the HVAC system 100 for conditioning before supplying the air to the conditioned space again. As illustrated, the vent 118 is coupled to the side 110 of the housing 112 and is positioned adjacent to the intake hood system 102. In other embodiments, the intake hood system 102 and/or the vent 118 may be positioned elsewhere relative to the housing 112, such as on different sides 110 of the housing 112.

Figure 6:
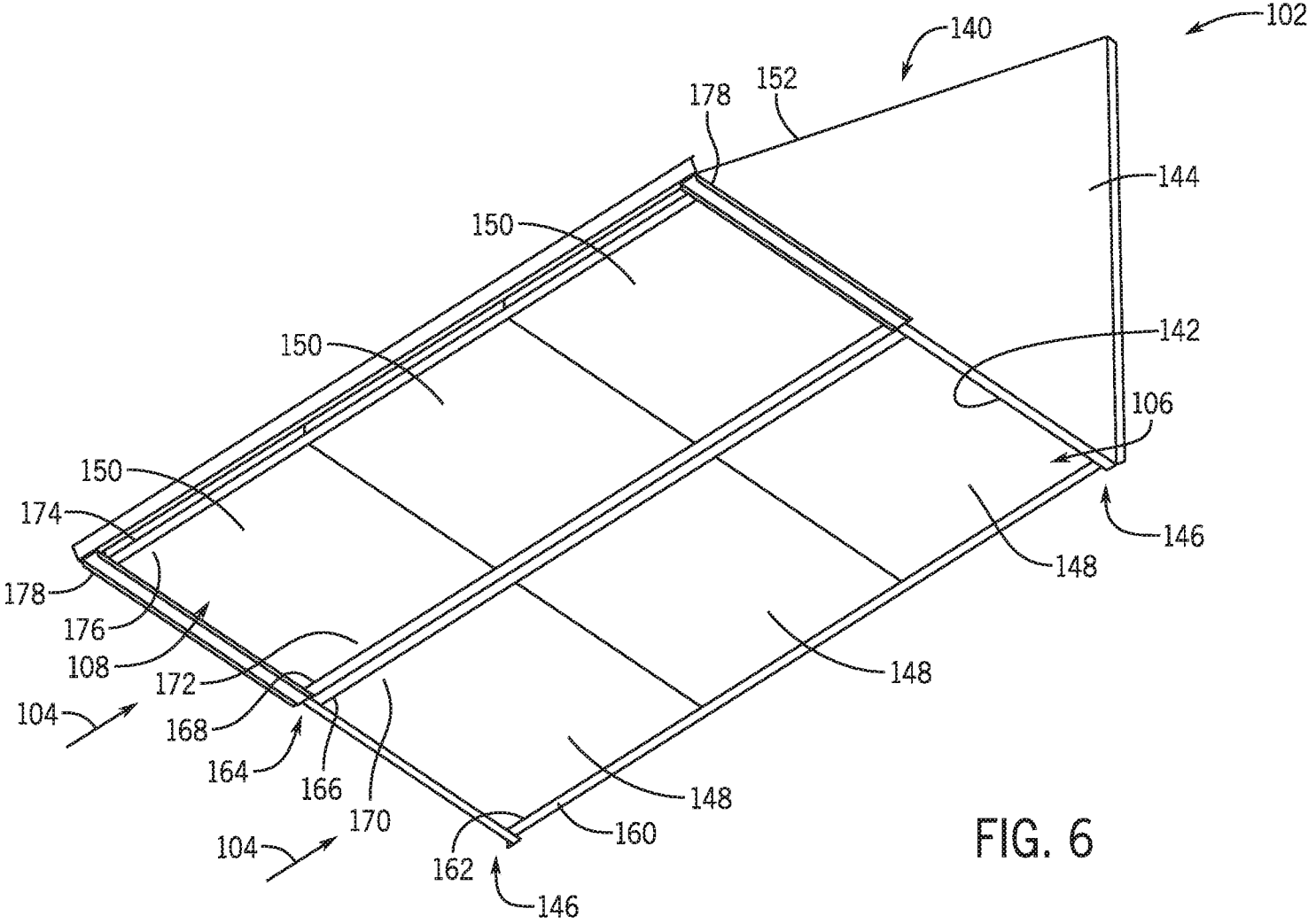
FIG. 6 is a perspective view of an embodiment of an intake hood system, in accordance with an aspect of the present disclosure.

FIG. 6 is a perspective view of an embodiment of the intake hood system 102, illustrating an installed configuration of the intake hood system 102 and the air filters 106 and 108. As illustrated, the intake hood system 102 includes an intake hood 140 configured to receive and direct air into the HVAC system 100. For example, air may pass through the air filters 106 and 108 disposed within or at an inlet 142 of the intake hood 140, as indicated by arrows 104. The inlet 142 is at least partially defined by side panels 144 of the intake hood 140 that are disposed at ends 146 or lateral sides of the intake hood system 102. For example, each side panel 144 may define a boundary portion of the inlet 142, such as a side boundary portion. In the illustrated embodiment, the air filter 106 includes a plurality of air filter segments 148 disposed between the side panels 144, and the air filter 108 includes a plurality of air filter segments 150 disposed between the side panels 144. Further, the intake hood 140 includes a top panel 152 disposed between and coupled to the side panels 144. Each of the side panels 144 and the top panel 152 are configured to direct air received through the air filters 106 and 108 through the intake hood system 102 and toward an interior of the housing 112.

As illustrated, the intake hood system 102 includes a support 160 disposed between the side panels 144 and aligned with a boundary of the inlet 142. In certain embodiments, the support 160 may be interference fit between the side panels 144 and/or disposed adjacent to the housing 112 of the HVAC system 100. The support 160 is configured to engage with and/or capture an end 162 of the air filter 106. The intake hood system 102 also includes an intermediate bracket 164 having supports 166 and 168 and disposed between the side panels 144. The support 166 is configured to engage/capture an end 170 of the air filter 106 generally opposite of the end 162, and the support 168 is configured to engage/capture an end 172 of the air filter 108. As such, the intermediate bracket is disposed between the air filters 106 and 108. Additionally, the intake hood system 102 includes a support 174 disposed between the side panels 144 and configured to engage/capture an end 176 of the air filter 108 generally opposite of the end 172. As illustrated, each of the supports 160, 166, 168, and 174 are C-channels configured to engage and/or capture respective ends of the air filters 106 and 108. In certain embodiments, the supports 160, 166, 168, and/or 174 may be other suitable supports configured engage ends of the air filters 106 and/or 108, such as L-brackets, angular tubing, circular tubing, or other suitable channels, tubing, and/or brackets. In certain embodiments, the intermediate bracket 164 may be an I-bracket having and/or formed by the supports 166 and 168. For example, each of the supports 166 and 168 may be C-channels that open toward opposite directions and that form an "I" shape.

As described in greater detail below, the intake hood system 102 facilitates improved access to and/or installation/replacement of the air filters 106 and 108. For example, during an installation process, the air filter 106 may slide into lateral supports, such as C-channels, of the side panels 144 and into the support 160. The intermediate bracket 164 may then be inserted between the side panels 144, such that the support 166 captures the end 170 of the air filter 106 and secures the air filter 106 within the intake hood system 102. The air filter 108 may then be inserted into the support 168 and between the side panels 144, and the support 174 may be inserted into the intake hood system 102, such that the support 174 captures the end 176 of the air filter 108. Thereafter, lock bars 178 of the intake hood system 102 may be coupled to the side panels 144 to secure the air filter 108 with the intake hood 140 of the intake hood system 102. In this manner, the intake hood system 102 may be configured for quick assembly/disassembly and replacement/installation of the air filters 106 and 108. As illustrated, the lock bars 178 are coupled to the side panels 144 of the intake hood 140 along a length of the intake hood 140 extending in a first direction that is transverse to a second direction in which the supports 160, 166, 168, and 174 extend. In certain embodiments, the lock bars 178 may be coupled to the side panels 144 in other positions, such as extending generally in a common direction with the supports 160, 166, 168, and 174.

Figure 7:
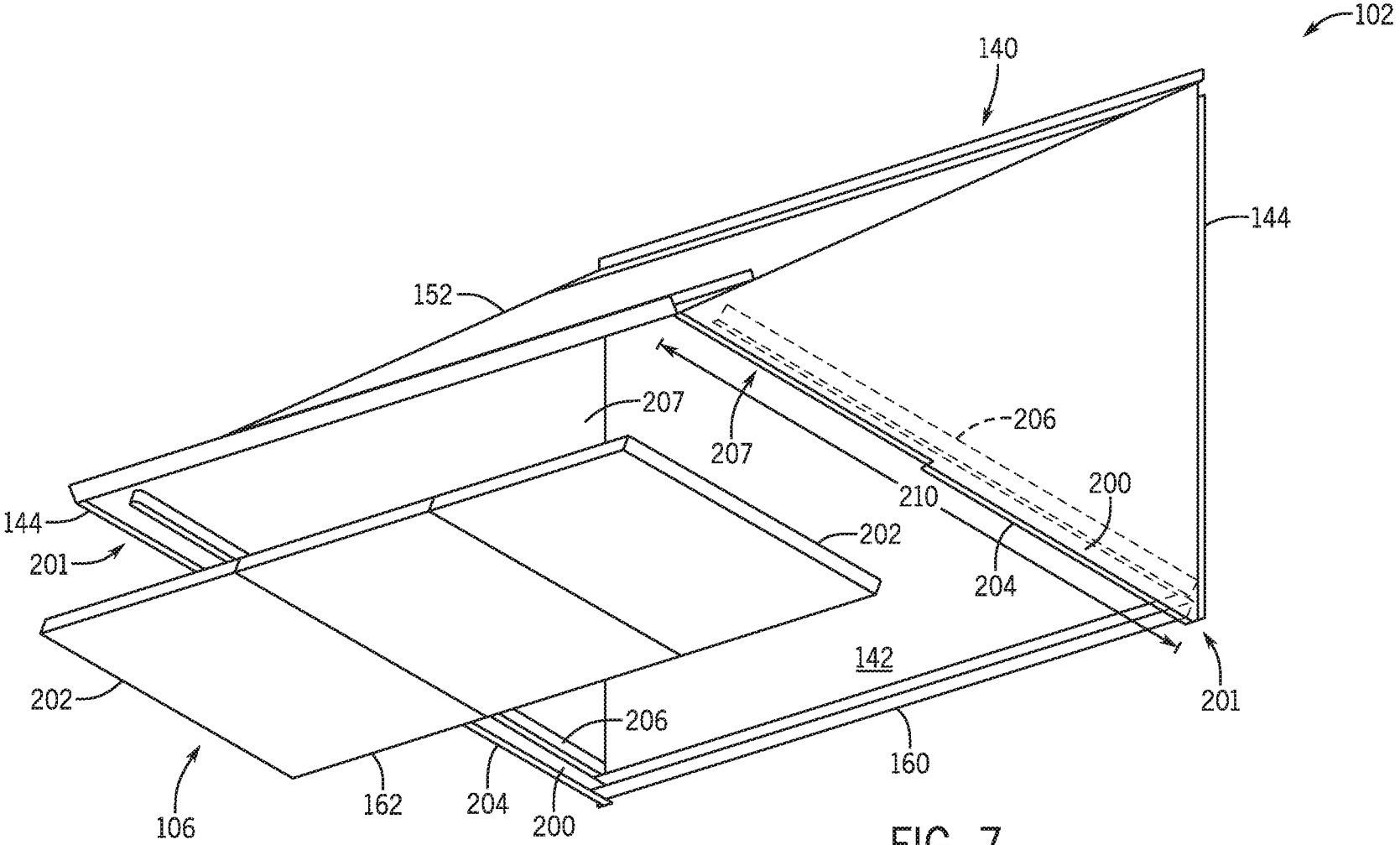
FIG. 7 is a perspective view of an embodiment of an intake hood system, illustrating installation of an air filter with a support of the intake hood system, in accordance with an aspect of the present disclosure.

FIG. 7 is a perspective view of an embodiment of intake hood system 102, illustrating installation of the air filter 106 and the support 160 with the intake hood 140. The side panels 144 of the intake hood 140 include lateral supports 200 that extend along a respective end 201 of each side panel 144 along the inlet 142 of the intake hood 140. The lateral supports 200 are configured to capture lateral sides 202, such as opposite lateral sides, of the air filter 106 when the air filter 106 is disposed within the inlet 142 of the intake hood 140. From the illustrated position outside the intake hood 140, the air filter 106 is configured to slide into the intake hood 140 via the lateral sides 202 and along the lateral supports 200 until the end 162 of the air filter 106 is received by and abuts the support 160. As illustrated, a length of the support 160 extends transverse to corresponding lengths of the lateral supports 200. In other embodiments, the support 160 and/or the lateral supports 200 may extend in a common direction or in other suitable directions to engage the air filter 106.

As illustrated, the lateral supports 200 are formed by flanges 204 that are integral to the side panels 144 and flanges 206 that are fastened and/or secured to the side panels 144 in an interior region of the intake hood 140. For example, each side 202 of the air filter 106 may be disposed between the flanges 204 and 206 of one of the side panels 144. The flanges 204 and 206 form C-channels of the lateral supports 200 that capture/engage the lateral sides 202 of the air filter 106, such that the lateral supports 200 may be lateral channels. In certain embodiments, the flanges 204 may be separate components that are fastened and/or secured to the side panels 144, and/or the flanges 206 may be integral to the side panels 144. In some embodiments, the flanges 204 and/or 206 may be inner flanges of the side panels 144. As mentioned above, each of the flanges 204 and 206 is disposed along interiors 207 of the side panels 144. As illustrated, the flanges 204 extend approximately one half of a length 210 of the side panels 144, and the flanges 206 extend along a majority of the length 210 the side panels 144. When inserting the air filter 106 into the intake hood 140, the sides 202 of the air filter 106 may first abut the flanges 206. Then, the air filter 106 may slide into the lateral supports 200 and abut both the flanges 204 and the flanges 206. As such, the lateral supports 200 enable quick and efficient insertion and removal of the air filter 106 into and from the intake hood 140.

Figure 8:
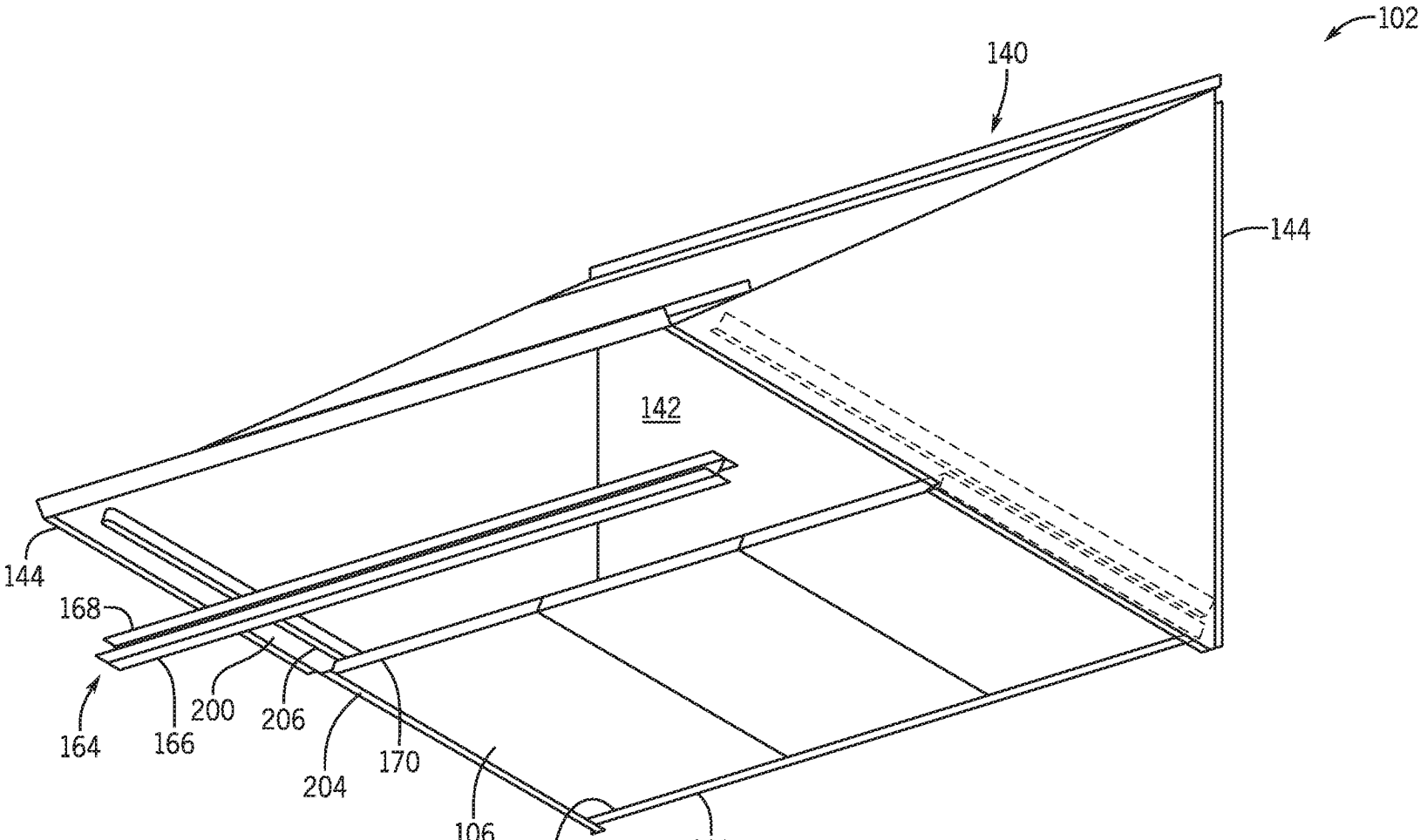
FIG. 8 is a perspective view of an embodiment of an intake hood system, illustrating installation of an intermediate bracket of the intake hood system, in accordance with an aspect of the present disclosure.

FIG. 8 is a perspective view of an embodiment of the intake hood system 102, illustrating installation of the intermediate bracket 164 with the intake hood system 102. As described herein, the support 166 of the intermediate bracket 164 is configured to capture the end 170 of the air filter 106, and the support 168 of the intermediate bracket 164 is configured to capture the end 172 of the air filter 108. From the illustrated position of the intermediate bracket 164 outside of the intake hood 140, the intermediate bracket 164 is configured to slide onto the end 170 of the air filter 106 and between the side panels 144. In certain embodiments, the intermediate bracket 164 may be at partially disposed within the lateral supports 200, similar to the air filter 106. For example, the intermediate bracket 164 may at least partially abut the flanges 204 and/or the flanges 206 when coupled to the air filter 106. In some embodiments, the support 166 of the intermediate bracket 164 may be disposed within the lateral supports 200, but the support 168 of the intermediate bracket 164 may not be disposed within the lateral supports 200. As such, the intermediate bracket 164 and/or the support 166 may be interference fit between the side panels 144 and/or between the flanges 204 and 206 of each lateral support 200.

In certain embodiments, the intermediate bracket 164 may be coupled to the air filter 106 prior to insertion of the air filter 106 into the intake hood 140. For example, the end 170 of the air filter 106 may be inserted into the support 166 of the intermediate bracket 164, and both the air filter 106 and the intermediate bracket 164 may be inserted into the intake hood 140, such as by sliding the air filter 106 and the intermediate bracket 164 into the lateral supports 200 until the end 162 of the air filter 106 is received by and abuts the support 160.

Figure 9:
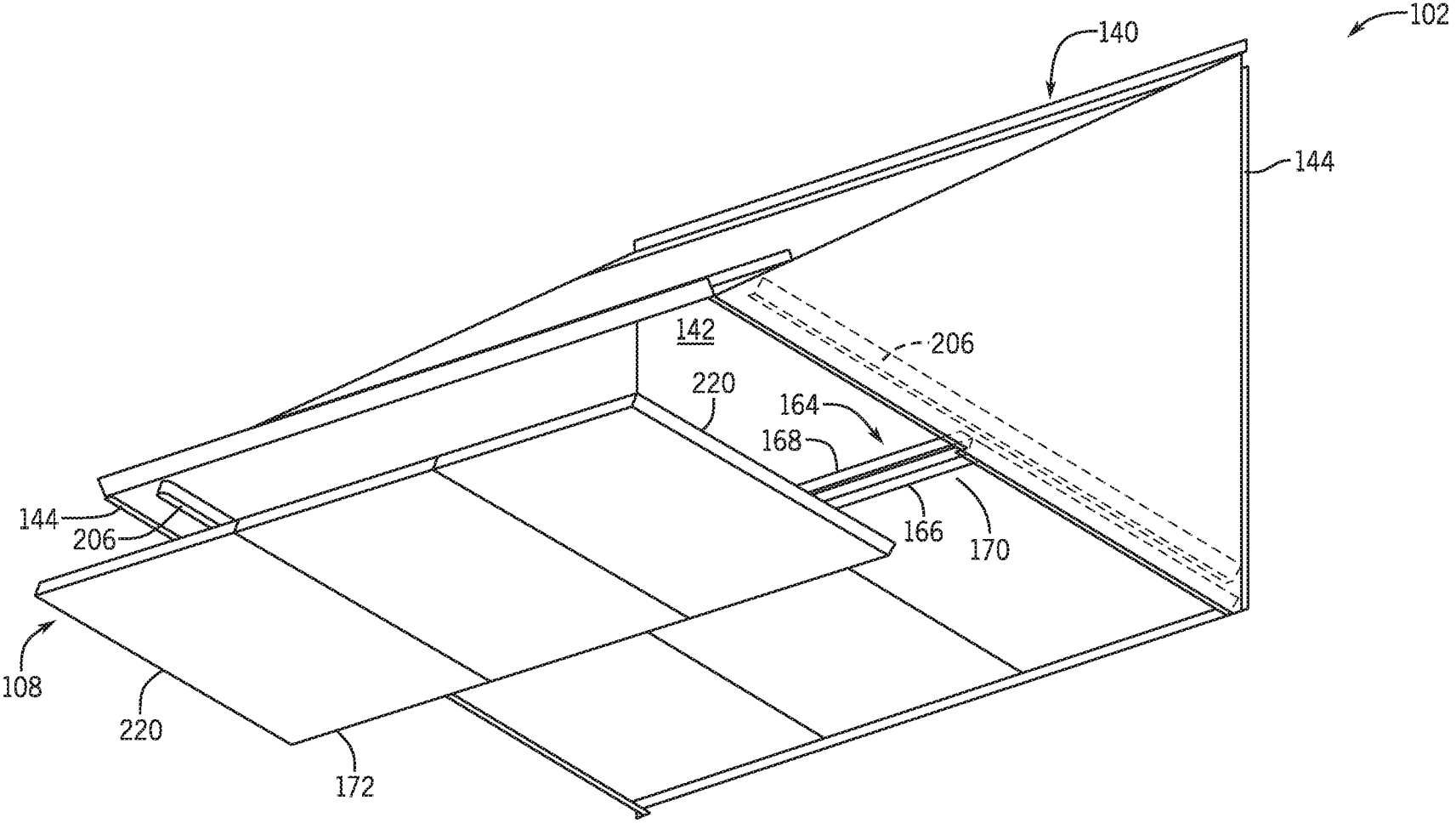
FIG. 9 is a perspective view of an embodiment of an intake hood system, illustrating installation of an additional air filter of the intake hood system, in accordance with an aspect of the present disclosure.

FIG. 9 is a perspective view of an embodiment of the intake hood system 102, illustrating installation of the air filter 108 with the intake hood system 102. From the illustrated position of the air filter 108 outside of the intake hood 140, the end 172 of the air filter 108 is configured to slide into the support 168 and be disposed between the side panels 144. For example, sides 220 of the air filter 108 may abut the flanges 206 of the side panels 144 while disposed between the side panels 144.

In certain embodiments, the air filter 108 may be coupled to the intermediate bracket 164 prior to insertion into the intake hood 140. For example, the end 172 of the air filter 108 may be inserted into the support 168 of the intermediate bracket 164 outside of the intake hood 140, and both the air filter 108 and the intermediate bracket 164 may be inserted into the intake hood 140, such as by sliding the support 166 of the intermediate bracket 164 onto the end 170 of the air filter 106 and in between the side panels 144. In some embodiments, the air filter 106, the intermediate bracket 164, and the air filter 108 may be assembled prior to insertion into the intake hood 140 and thereafter inserted as a filter and bracket assembly into the intake hood 140.

Figure 10:
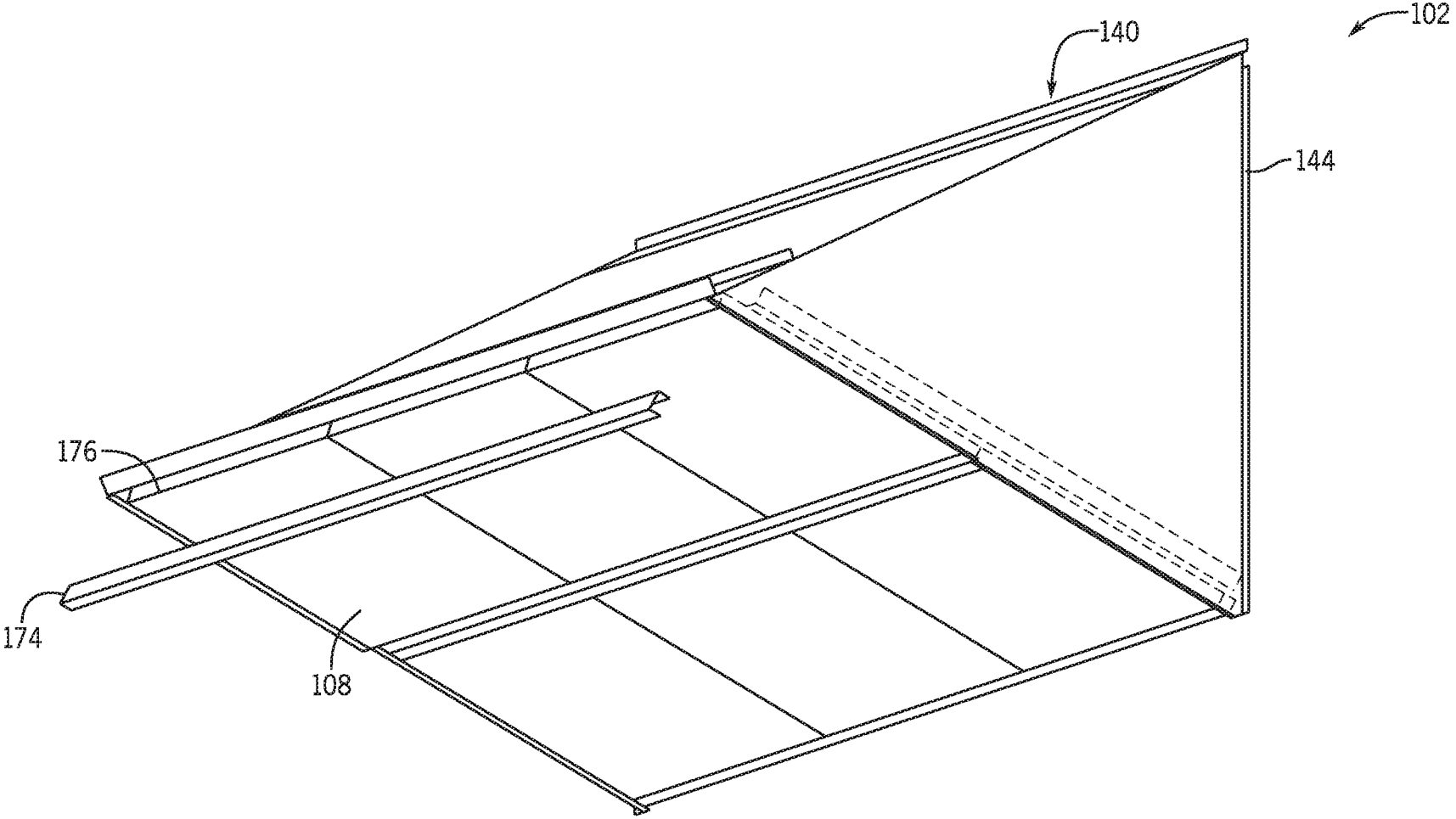
FIG. 10 is a perspective view of an embodiment of an intake hood system, illustrating installation of an additional support of the intake hood system, in accordance with an aspect of the present disclosure.

FIG. 10 is a perspective view of an embodiment of the intake hood system 104, illustrating installation of the support 174 with the intake hood system 102. As illustrated, the support 174 is disposed outside the intake hood 140. The support 174 is configured to slide onto and capture the end 176 of the air filter 108. In certain embodiments, the support 174 may be coupled to the end 176 of the air filter 108 prior to insertion of the air filter 108, the intermediate bracket 164, and/or the air filter 106 into the intake hood 140. As such, the support 174 may be offset from the lateral supports 200 and the flanges 204 of the side panels 144. For example, the end 176 of the air filter 108 may be inserted into the support 174, and then the support 174, the air filter 108, the intermediate bracket 164, and/or the air filter 106 may be simultaneously inserted into the intake hood 140.

Figure 11:
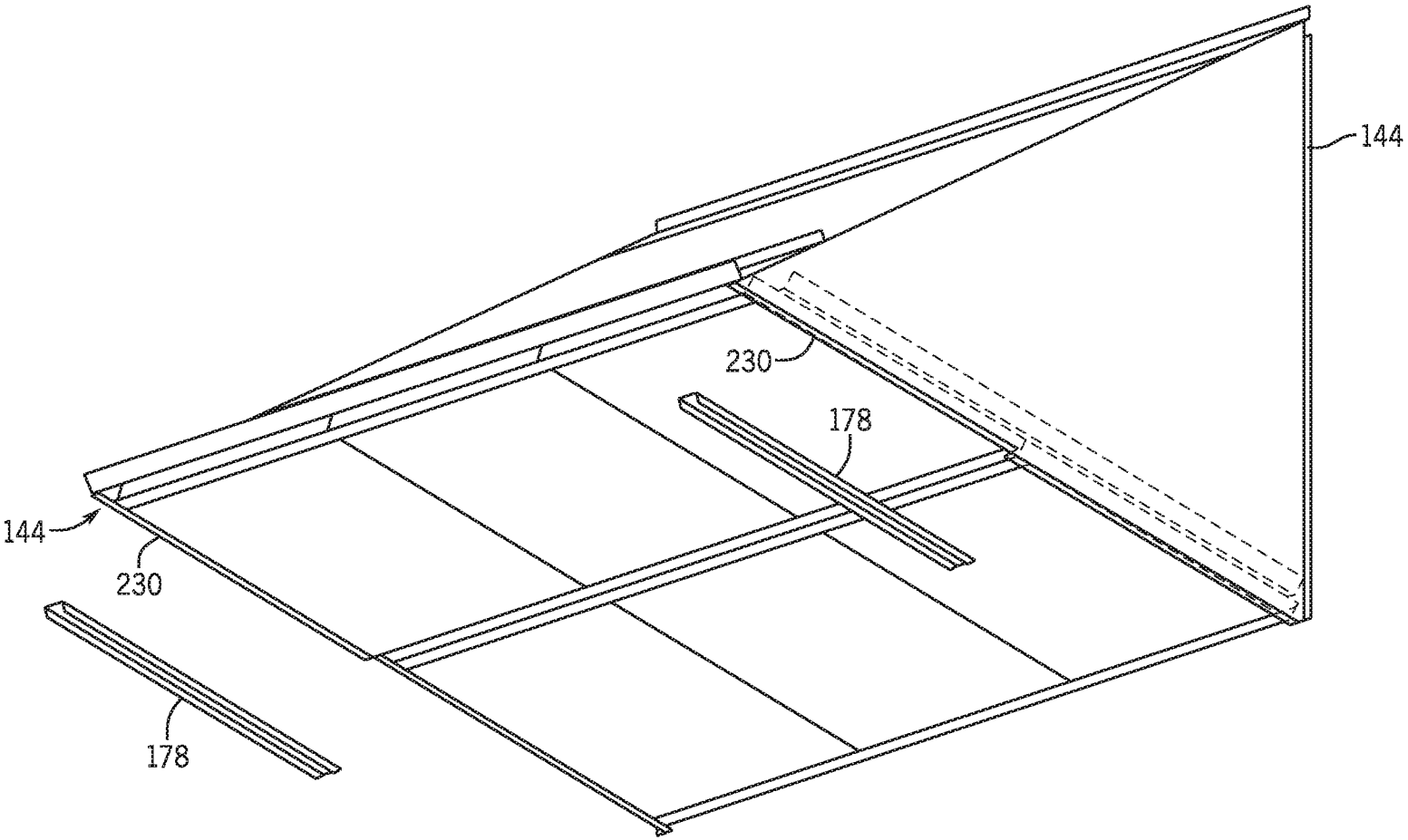
FIG. 11 is a perspective view of an embodiment of an intake hood system, illustrating installation of lock bars of the intake hood system, in accordance with an aspect of the present disclosure.

FIG. 11 is a perspective view of an embodiment of the intake hood system 102, illustrating installation of the lock bars 178 with the intake hood system 102. From the illustrated position of the lock bars 178 apart from the intake hood 140, the lock bars 178 may be coupled to flanges 230 of the side panels 144 to secure the air filter 108 within the inlet 142 of the intake hood 140. The flanges 230 extend outwardly from the side panels 144 and the inlet 142. As described in greater detail below, each lock bar 178 may be coupled to one of the flanges 230 via fasteners. Once secured to the intake hood 140, the lock bars 178 are configured to abut the supports 166, 168, and/or 174 to secure the air filter 108 within the inlet 142 of the intake hood 140. For example, the air filter 108 may be disposed/captured between the flanges 206 of the side panels 144 and the lock bars 178. As such, in certain embodiments, the flanges 206 and the lock bars 178 may cooperatively form lateral supports configured to capture the sides 220 of the air filter 108. In certain embodiments, the supports 166, 168, and/or 174 and/or the air filter 108 may be disposed laterally between the flanges 230 of the side panels 144. Referring back to FIG. 6, the lock bars 178 are coupled to the flanges 230 of the side panels 144 such that lock bars 178 secure the air filter 108 within the inlet 142 of the intake hood 140. As illustrated, the lock bars 178 are channeled members, such as C-channels. In other embodiments, the lock bars 178 may be any shape suitable for abutting the supports 166, 168, and/or 174 to secure the air filter 108 within the inlet 142 of the intake hood 140 when coupled to the flanges 230, such as flattened plates, angular brackets, tubes, and other suitable shapes.

Figure 12:
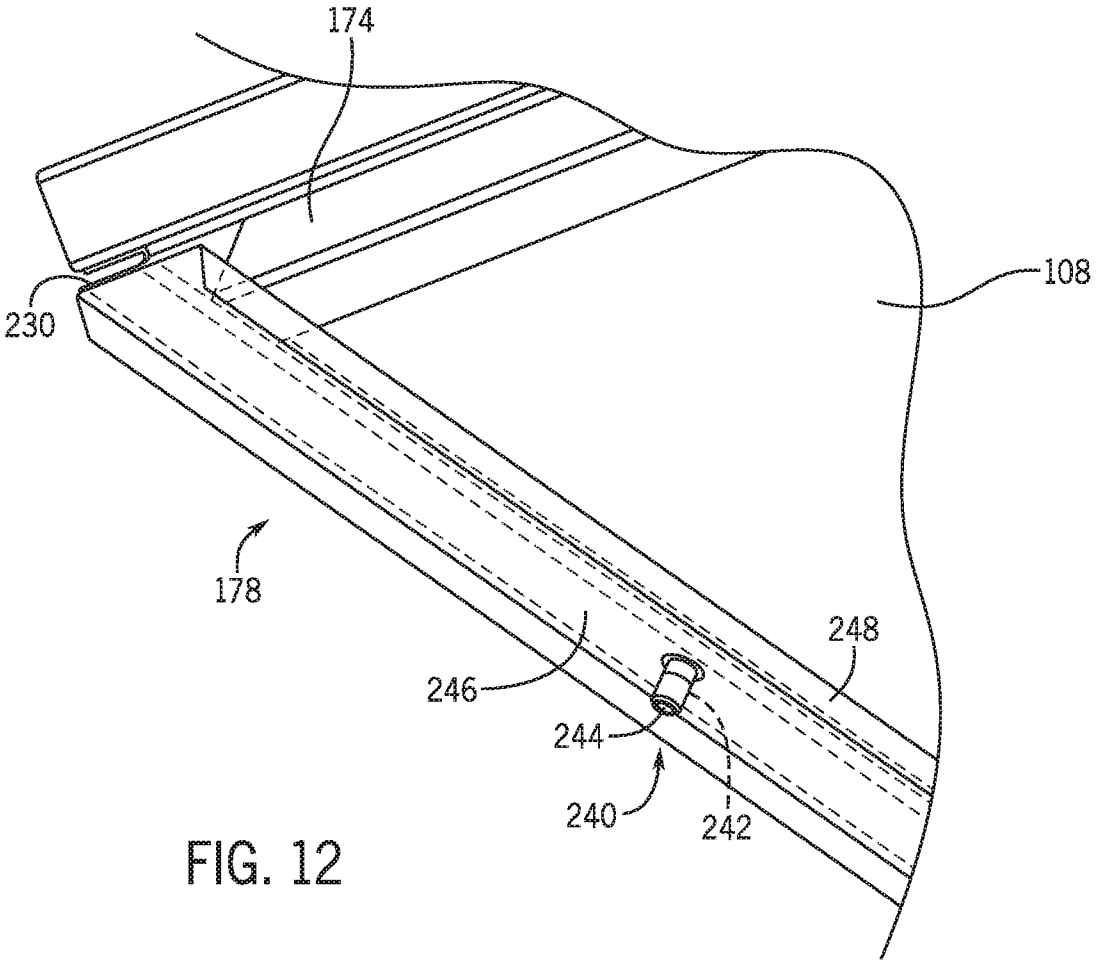
FIG. 12 is an expanded perspective view of an embodiment of the intake hood system, illustrating an installed lock bar of the intake hood system, in accordance with an aspect of the present disclosure.

FIG. 12 is an expanded perspective view of an embodiment of the intake hood system 102, illustrating the lock bar 178 coupled to the intake hood 140. As shown, the lock bar 178 is coupled to the flange 230 of the side panel 144 via a fastener assembly 240. The fastener assembly 240 is configured to extend through the lock bar 178 and the flange 230 to secure the lock bar 178 to the intake hood 140. Additionally, the fastener assembly 240 may be reusable such that at least a portion of the fastener assembly 240 may be removed and reinstalled multiple times to enable repeated removal and reinstallation of the lock bar 178 and access to the air filters 106 and 108 without replacement of the fastener assembly 240. As illustrated, the fastener assembly 240 includes a fastener 242, such as a screw or a bolt, and a nut 244, such as a thumb nut or a rivet nut, threadingly engaged with one another. The nut 244 may be removed from and reattached to the fastener 242 multiple times without damaging the fastener assembly 240, the lock bar 178, or the flange 230. For example, the nut 244 may be unscrewed from the fastener 242 and/or attached to the fastener 242 by hand or tool without damaging threads of the fastener 242 or the nut 244, and the fastener assembly 240 may be removed from and reinserted through the lock bar 178 and the flange 230 without damaging the lock bar 178 or the flange 230. In some embodiments, one or more portions of the fastener assembly 240 may be fixed to the lock bar 178 and/or the flange 230. For example, the fastener 242 may be rigidly fixed to the flange 230 and configured to extend from the flange 230. In such embodiments, the lock bar 178 may be inserted over the fastener 242 and the nut 244 attached to the fastener 242 to secure the lock bar 178 to the flange 230. In certain embodiments, the nut 244 may be rigidly fixed to the lock bar 178, such as integrally formed with and/or press fit to the lock bar 178, such that the fastener 242 may be inserted through the flange 230 and the lock bar 178 and into the nut 244 to secure the lock bar 178 to the flange 230.

As illustrated, the lock bar 178 includes a portion 246 that extends along and abuts the flange 230. In certain embodiments, the portion 246 may extend along the entire flange 230. The lock bar 178 also includes a portion 248 that extends along the air filter 108, the support 174, the intermediate bracket 164, and/or the flange 204 of the side panel 144. The portion 248 enables the lock bar 178 to secure the air filter 108, the support 174, and/or the intermediate bracket 164 within the intake hood 140. For example, while the lock bar 178 is secured to the intake hood 140, such as via the portion 246 secured to the flange 230, the lock bar 178 may also support and retain the air filter 108, the support 174, and/or the intermediate bracket 164 within the inlet 142 of the intake hood 140, such as via the portion 248 that abuts the air filter 108, the support 174, the intermediate bracket 164, and/or the flange 204.

Figure 13:
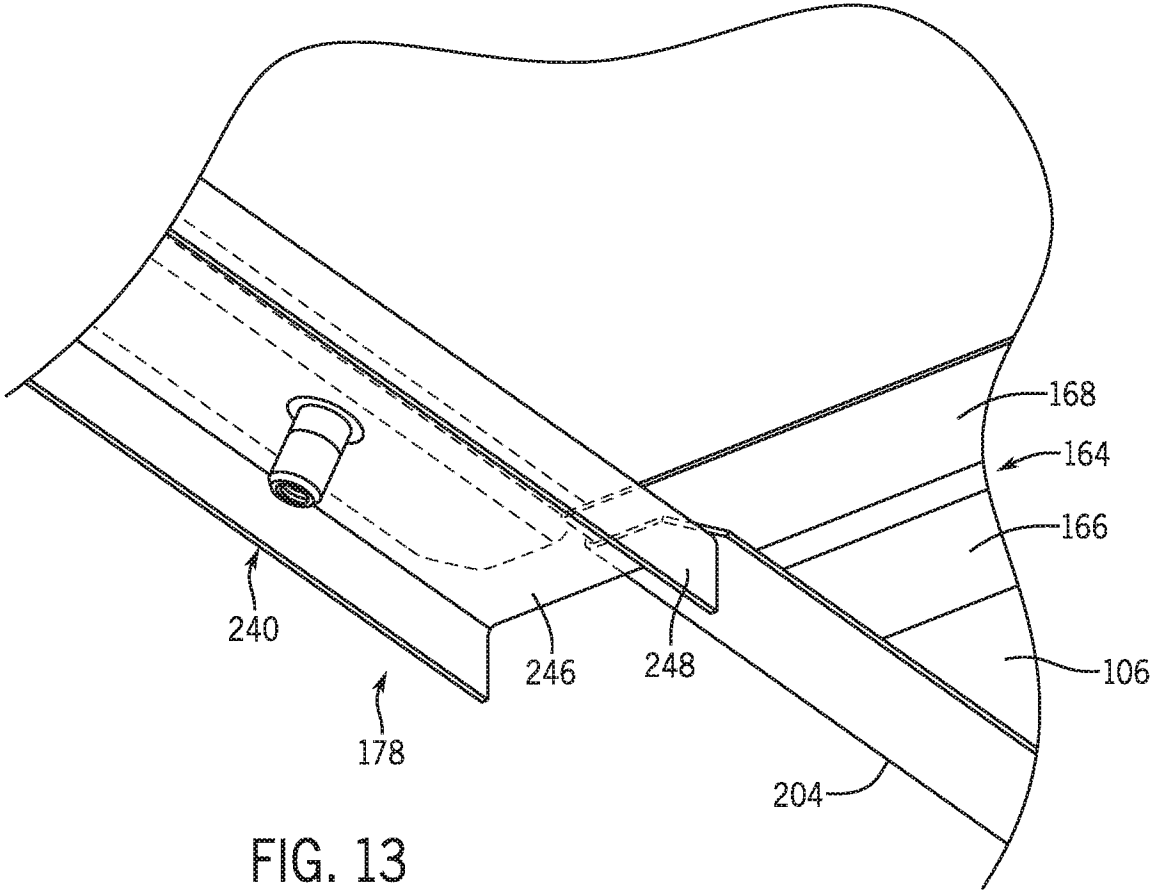
FIG. 13 is an expanded perspective view of an embodiment of the intake hood system, illustrating an installed lock bar of the intake hood system, in accordance with an aspect of the present disclosure.

FIG. 13 is an expanded perspective view of an embodiment of the intake hood system 102, illustrating the lock bar 178 coupled to the flange 230 of the intake hood 140. The lock bar 178 is secured to the flange 230 via the fastener assembly 240, which extends through the portion 246 of the lock bar 178. As described above, the portion 248 of the lock bar 178 may extend along and generally abut the air filter 108, the support 174, the intermediate bracket 164, and/or the flange 204 of the side panel 144. As illustrated, the lock bar 178 extends along and abuts the air filter 108, the support 168 of the intermediate bracket 164, and/or the flange 204. In certain embodiments, the portion 248 may extend along and abut the air filter 108 without directly abutting other components. In some embodiments, the portion 248 may extend along and abut both of the supports 166 and 168 of the intermediate bracket 164. In further embodiments, the portion 248 of the lock bar 178 may extend along and abut the air filter 106 and/or a majority of the flange 204 of the side panel 144. As such, the lock bar 178, via the portions 246 and 248, is configured to secure the air filters 106 and/or 108, the support 174, and/or the supports 166 and/or 168 of the intermediate bracket 164 within the intake hood 140. In the illustrated embodiments, each lock bar 178 is coupled to one of the flanges 230 via two fastener assemblies 240. In some embodiments, one or both lock bars 178 may be coupled to the flanges 230 via more or fewer fastener assemblies 240, such as by one fastener assembly 240, three fastener assemblies 240, four fastener assemblies 240, or six fastener assemblies 240.

Figure 14:
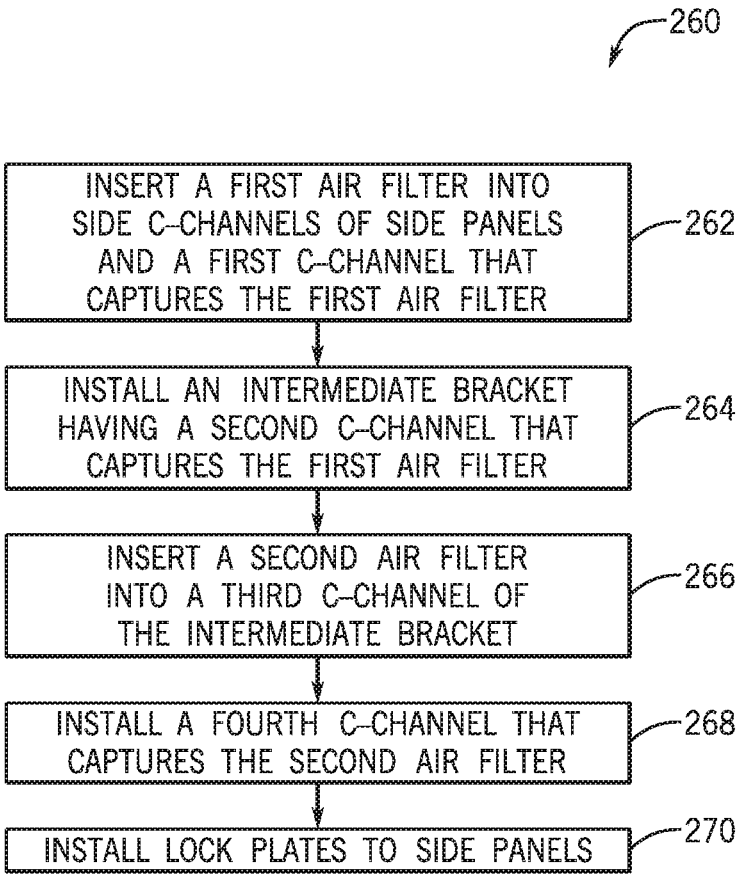
FIG. 14 is a flow diagram of an embodiment of a process for assembling an intake hood system, in accordance with an aspect of the present disclosure.

FIG. 14 is a flow diagram of an embodiment of a process 260 for assembling the intake hood system 102. At block 262, the air filter 106 is inserted into the lateral supports 200, such as lateral channels, and into the support 160, such as a C-channel. For example, the sides 202 of the air filter 106 may be inserted between the flanges 204 and 206 that form the lateral supports 200 and slid into the lateral supports 200 until the end 162 of the air filter 106 abuts the support 160. In certain embodiments, one or more of the plurality of air filter segments 148 of the air filter 106 may be individually inserted into the intake hood 140, such as into the lateral supports 200 and/or into the support 160.

At block 264, the intermediate bracket 164 is installed, such that the support 166 captures and fits over the end 170 of the air filter 106. As described above, the support 166 of the intermediate bracket 164 may be coupled to the air filter 106 prior to insertion of the air filter 106 into the intake hood 140. For example, the air filter 106 may first be inserted into the support 166, and both the air filter 106 and the intermediate bracket 164 may be inserted/installed to the intake hood 140.

At block 266, the air filter 108 is inserted into the support 168 of the intermediate bracket 164, which is configured to capture the end 172 of the air filter 108. In certain embodiments, the air filter 108 may be coupled to the intermediate bracket 164 and/or the air filter 106 prior to insertion of the intermediate bracket 164 and/or the air filter 106 into the intake hood 140. In some embodiments, one or more of the plurality of air filter segments 150 of the air filter 108 may be individually inserted into the intake hood 140, such as into the support 168 of the intermediate bracket 164.

At block 268, the support 174 is inserted over the air filter 108. For example, the support 174 is configured to capture the end 176 of the air filter 108. In certain embodiments, the support 174 may be coupled to the air filter 108 prior to insertion of the air filter 108 into the intake hood 140.

At block 270, the lock bars 178, such as lock plates, are installed/coupled to the intake hood 140 to secure the air filter 108, the support 174, and/or the intermediate bracket 164 within the inlet 142 of the intake hood 140. For example, the lock bars 178 may be positioned adjacent to the side panels 144, such that the lock bars 178 abut the flanges 230 of the side panels 144, and at least a portion each fastener assembly 240 may be inserted into/through the lock bars 178 to secure the lock bars 178 to the intake hood 140. As such, after inserting the air filters 106 and 108, the intermediate bracket 164, and the support 174 into the inlet 142 of the intake hood 140, the lock bars 178 may be fastened to the side panels 144 to secure the air filters 106 and 108, the intermediate bracket 164, and the support 174 within the inlet 142.

Figure 15:
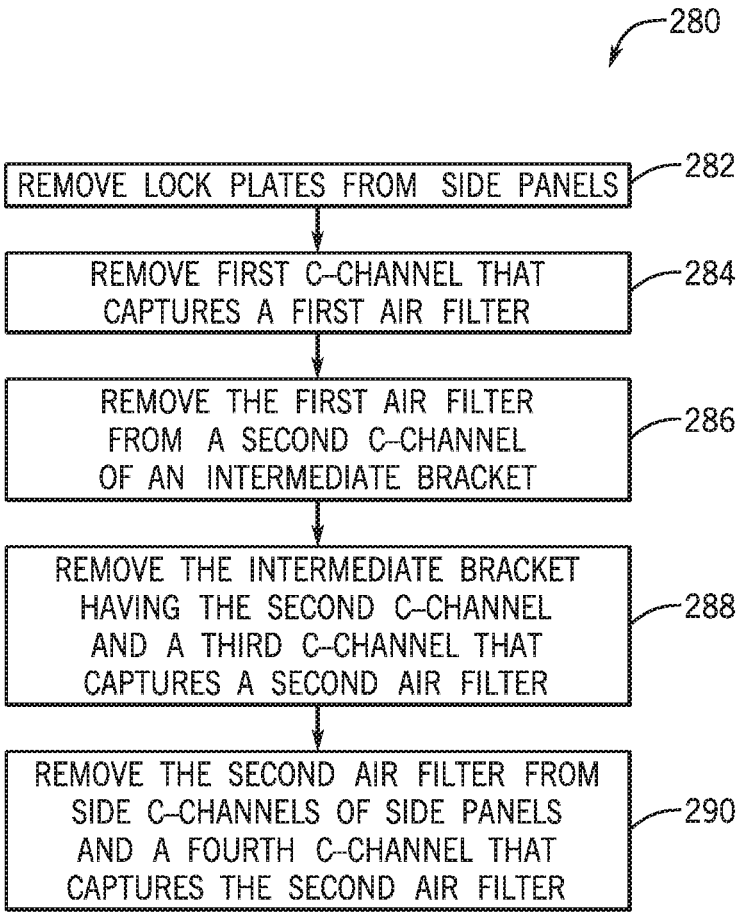
FIG. 15 is a flow diagram of an embodiment of a process for disassembling an intake hood system, in accordance with an aspect of the present disclosure.

FIG. 15 is a flow diagram of an embodiment of a process 280 for disassembling the intake hood system 102. At block 282, the lock bars 178 are removed from the intake hood 140 to enable removal of the air filter 108, the support 174, and/or the intermediate bracket 164 from the intake hood 140. For example, at least a portion of the each fastener assembly 240 may be removed to enable removal/uninstallation of the lock bars 178. As described above, the nut 244 of each fastener assembly 240, such as a thumb nut, may be unscrewed from each respective fastener 242 to enable removal of the lock bars 178.

At block 284, the support 174 is removed from the end 176 of the air filter 108. At block 286, the air filter 108 is removed from the support 168 of the intermediate bracket 164. In certain embodiments, the support 174 and the air filter 108 may be removed at substantially the same time, such as simultaneously, from the intake hood 140. In some embodiments, one or more of the plurality of air filter segments 150 of the air filter 108 may be individually removed from the intake hood 140, such as from the support 168 of the intermediate bracket 164.

At block 288, the intermediate bracket 164 having the supports 166 and 168 is removed from the intake hood 140. For example, after removing the air filter 108, the intermediate bracket 164 may be pulled off the air filter 106. In certain embodiments, the intermediate bracket 164 may be removed from the intake hood 140 at the same time as the air filter 108, such that the air filter 108 is still disposed within the support 168 of the intermediate bracket 164 when the air filter 108 and the intermediate bracket 164 are removed from the intake hood.

At block 290, the air filter 106 is removed from the intake hood 140. For example, the end 162 of the air filter 106 may be removed from the support 160, and the sides 202 of the air filter 106 may be slid along and out of the lateral supports 200 until the air filter 106 is removed from the intake hood 140. In certain embodiments, the air filter 106 may be removed from the intake hood 140 at the same time as the intermediate bracket 164 such that the end 170 of the air filter 106 is still disposed within the support 166 of the intermediate bracket 164 when the intermediate bracket 164 and the air filter 106 are removed from the intake hood 140. In some embodiments, one or more of the plurality of air filter segments 148 of the air filter 106 may be individually removed from the intake hood 140, such as from the support 160.

Accordingly, the present disclosure provides systems and methods for an intake hood system generally positioned at an inlet of an HVAC system. The intake hood system includes air filters configured to remove dirt, debris, and other particles from air directed through the intake hood system and into, for example, a housing of an HVAC unit. The disclosed techniques enable quick and efficient access to the air filters, such as access by service personnel, to quickly service and/or replace the air filters. For example, the intake hood system may include supports, brackets, and/or side panels that capture the air filters. The supports, the brackets, and/or the side panels may be easily disassembled/uninstalled to remove the air filters and assembled/installed to insert/replace the air filters. As such, the systems and methods described herein improve serviceability of the HVAC system and facilitate installation of air filters.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. An intake hood system for a heating, ventilation, and/or air conditioning (HVAC) unit, comprising:

an intake hood including an inlet configured to receive an air flow into the intake hood and including a flange extending outwardly from the inlet;

a first support configured to engage a first end of an air filter and a second support configured to engage a second end of the air filter, wherein the first support is configured to align with a boundary of the inlet; and a lock bar configured to removably couple to the flange while abutting the first support to secure the air filter, the first support, and the second support within the intake hood against a force of gravity, wherein the lock bar is fixed to the flange while coupled to the flange.

2. The intake hood system of claim 1, wherein the intake hood includes a first side panel that defines a first boundary portion of the inlet and a second side panel that defines a second boundary portion of the inlet, wherein the first side panel comprises the flange.

3. The intake hood system of claim 1, wherein the intake hood includes a first side panel that defines a first boundary portion of the inlet and a second side panel that defines a second boundary portion of the inlet, wherein the first side panel comprises the flange, and the intake hood system includes a second lock bar configured to couple to an additional flange of the second side panel to secure the air filter within the intake hood.

4. The intake hood system of claim 1, comprising:

a third support configured to engage a first end of an additional air filter; and an intermediate bracket including both the second support and a fourth support configured to engage a second end of the additional air filter.

5. The intake hood system of claim 4, comprising:

a first side panel that defines a first boundary portion of the inlet;

a second side panel that defines a second boundary portion of the inlet;

a first lateral support of the first side panel configured to engage a first lateral side of the additional air filter; and a second lateral support of the second side panel configured to engage a second lateral side of the additional air filter that is opposite the first lateral side.

6. The intake hood system of claim 5, wherein the third support is configured to be disposed between the first lateral support of the first side panel and the second lateral support of the second side panel.

7. The intake hood system of claim 5, wherein the first and second lateral supports comprise C-channels formed via respective additional flanges of the first side panel and the second side panel.

8. The intake hood system of claim 4, comprising the air filter and the additional air filter, wherein the air filter includes a plurality of air filter segments, and the additional air filter includes a plurality of additional air filter segments.

9. The intake hood system of claim 1, wherein the lock bar includes a rivet nut configured to threadingly engage with a bolt extending through the flange to couple the lock bar to the intake hood.

10. The intake hood system of claim 1, wherein the lock bar is configured to couple to the intake hood along a length extending in a first direction transverse to a second direction in which the first support and the second support extend.

11. The intake hood system of claim 1, wherein the lock bar comprises a flattened plate, an angular bracket, or a tube.

12. The intake hood system of claim 1, wherein the first support comprises a first C-channel.

13. The intake hood system of claim 12, wherein the second support comprises a second C-channel.

14. The intake hood system of claim 13, wherein the second support comprises an I-bracket that includes the second C-channel and a third C-channel that are open toward opposite directions.

15. An intake hood system for a heating, ventilation, and/or air conditioning (HVAC) unit, comprising:

an intake hood defining an inlet configured to receive an air flow into the intake hood;

a first support configured to engage a first end of an air filter and a second support configured to engage a second end of the air filter, wherein the first support is configured to align with a first boundary portion of the inlet and is configured to be disposed within the intake hood;

a side panel of the intake hood defining a second boundary portion of the inlet, wherein the side panel comprises a flange extending outwardly from the inlet;

a lock bar configured to couple to the flange to secure the air filter within the intake hood; and an additional lock bar configured to couple to an additional side panel of the intake hood to secure the air filter within the intake hood, wherein the lock bar and the additional lock bar are configured to separately couple to the intake hood, and wherein the lock bar and the additional lock bar are separately removable from the intake hood.

16. The intake hood system of claim 15, wherein the flange extends along the side panel in a first direction transverse to a second direction in which the first support and the second support extend.

17. An intake hood system for a heating, ventilation, and/or air conditioning (HVAC) unit, comprising:

an intake hood comprising an inlet configured to receive an air flow into the intake hood;

a first support configured to engage a first end of an air filter and a second support configured to engage a second end of the air filter, wherein the first support is configured to align with a first boundary portion of the inlet, and wherein the first support and the second support are configured to be disposed within the intake hood;

a first side panel of the intake hood defining a second boundary portion of the inlet;

a second side panel of the intake hood defining a third boundary portion of the inlet;

a first lateral support of the first side panel configured to engage a first lateral side of an additional air filter;

a second lateral support of the second side panel configured to engage a second lateral side of the additional air filter that is opposite the first lateral side;

a first lock bar configured to couple to the first side panel; and a second lock bar configured to couple to the second side panel, wherein the first lock bar and the second lock bar are configured to secure the air filter within the intake hood.

* * * * *